US009767650B2

(12) United States Patent
Jaffe et al.

(10) Patent No.: US 9,767,650 B2
(45) Date of Patent: Sep. 19, 2017

(54) WAGERING GAME WITH DYNAMIC BONUS TRIGGERS

(71) Applicant: Bally Gaming, Inc., Las Vegas, NV (US)

(72) Inventors: Joel R. Jaffe, Glenview, IL (US); Jeffry L. Nauman, Yorkville, IL (US); Keith Burza, Joliet, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/878,816

(22) Filed: Oct. 8, 2015

(65) Prior Publication Data

US 2016/0027258 A1 Jan. 28, 2016

Related U.S. Application Data

(63) Continuation of application No. 13/794,261, filed on Mar. 11, 2013, now Pat. No. 9,183,704.

(60) Provisional application No. 61/676,002, filed on Jul. 26, 2012.

(51) Int. Cl.
*G07F 17/34* (2006.01)
*G07F 17/32* (2006.01)

(52) U.S. Cl.
CPC ..... *G07F 17/3258* (2013.01); *G07F 17/3244* (2013.01); *G07F 17/3262* (2013.01); *G07F 17/3267* (2013.01); *G07F 17/34* (2013.01)

(58) Field of Classification Search
CPC ... G07F 17/3267; G07F 17/3262; G07F 17/34
See application file for complete search history.

(56) References Cited

U.S. PATENT DOCUMENTS

| | | | |
|---|---|---|---|
| 5,152,529 | A | 10/1992 | Okada |
| 5,833,537 | A | 11/1998 | Barrie |
| 5,833,538 | A | 11/1998 | Weiss |
| 6,089,977 | A | 7/2000 | Bennett |
| 6,190,254 | B1 | 2/2001 | Bennett |
| 6,251,013 | B1 | 6/2001 | Bennett |
| 6,270,411 | B1 | 8/2001 | Gura |

(Continued)

FOREIGN PATENT DOCUMENTS

EP 1150261 10/2001

*Primary Examiner* — Dmitry Suhol
*Assistant Examiner* — David Duffy
(74) *Attorney, Agent, or Firm* — David J. Bremer

(57) ABSTRACT

A gaming system for conducting a wagering game includes input device(s), display device(s), processor(s), and memory device(s). The memory devices store instructions that, when executed, cause the gaming system to receive a wager to initiate each instance of the wagering game, randomly select a game outcome for each instance of the wagering game, display the randomly selected game outcome for each instance, and initiate a special event in response to an occurrence of a triggering event during an instance of the wagering game. At least two of the randomly selected outcomes include a first special symbol that has a dynamic secondary element. The dynamic secondary element represents a first enhancement in a first instance and a second enhancement in a second instance of the wagering game. The triggering event and special event are associated with at least one special symbol. The special event is modified by the dynamic secondary element.

20 Claims, 7 Drawing Sheets

(56) References Cited

U.S. PATENT DOCUMENTS

| | | | | |
|---|---|---|---|---|
| 6,290,600 | B1 | 9/2001 | Glasson | |
| 6,311,976 | B1 | 11/2001 | Yoseloff | |
| 6,517,432 | B1 | 2/2003 | Jaffe | |
| 6,517,433 | B2 | 2/2003 | Loose | |
| 6,551,187 | B1 | 4/2003 | Jaffe | |
| 6,780,109 | B2 | 8/2004 | Kaminkow | |
| 6,805,349 | B2 | 10/2004 | Baerlocher | |
| 6,811,486 | B1 | 11/2004 | Luciano, Jr. | |
| 6,866,583 | B2 | 3/2005 | Glavich | |
| 6,905,406 | B2 | 6/2005 | Kaminkow | |
| 7,169,042 | B2 | 1/2007 | Muir | |
| 7,530,894 | B1 * | 5/2009 | Marks | G07F 17/32 273/138.2 |
| 7,578,735 | B2 | 8/2009 | Frizzell | |
| 7,690,985 | B1 | 4/2010 | Muskin | |
| 7,695,365 | B2 | 4/2010 | Casey | |
| 7,972,210 | B2 | 7/2011 | Gallagher | |
| 8,602,862 | B2 | 12/2013 | Gauselmann | |
| 8,864,568 | B2 * | 10/2014 | Mizue | G07F 17/34 463/20 |
| 2002/0025849 | A1 | 2/2002 | Olive | |
| 2002/0039918 | A1 | 4/2002 | Anderson | |
| 2002/0052233 | A1 | 5/2002 | Gauselmann | |
| 2002/0155881 | A1 | 10/2002 | Yoshida | |
| 2003/0054874 | A1 | 3/2003 | Kaminkow | |
| 2003/0057645 | A1 | 3/2003 | Baerlocher | |
| 2003/0064793 | A1 | 4/2003 | Baerlocher | |
| 2003/0216166 | A1 | 11/2003 | Baerlocher | |
| 2003/0232644 | A1 | 12/2003 | Takahashi | |
| 2004/0033827 | A1 | 2/2004 | Gilmore | |
| 2004/0038730 | A1 | 2/2004 | Suda | |
| 2004/0053676 | A1 | 3/2004 | Rodgers | |
| 2004/0097279 | A1 | 5/2004 | Gauselmann | |
| 2004/0137982 | A1 | 7/2004 | Cuddy | |
| 2004/0209673 | A1 | 10/2004 | Shiraishi | |
| 2004/0219968 | A1 | 11/2004 | Fiden | |
| 2004/0219969 | A1 | 11/2004 | Casey | |
| 2004/0266515 | A1 | 12/2004 | Gauselmann | |
| 2005/0049031 | A1 | 3/2005 | Jackson | |
| 2005/0059478 | A1 | 3/2005 | Peterson | |
| 2006/0025205 | A1 | 2/2006 | Casey | |
| 2006/0073878 | A1 | 4/2006 | Shackelford | |
| 2006/0084492 | A1 | 4/2006 | Baerlocher | |
| 2006/0264254 | A1 | 11/2006 | Aoki | |
| 2007/0167201 | A1 | 7/2007 | Schultz | |
| 2007/0281779 | A1 | 12/2007 | Ozaki | |
| 2007/0287523 | A1 | 12/2007 | Esses | |
| 2008/0188286 | A1 | 8/2008 | Jaffe | |
| 2009/0253492 | A1 | 10/2009 | Caputo | |
| 2010/0069160 | A1 | 3/2010 | Barrett | |
| 2010/0190542 | A1 * | 7/2010 | Mizue | G07F 17/34 463/20 |
| 2010/0234099 | A1 | 9/2010 | Rasmussen | |
| 2011/0223984 | A1 | 9/2011 | Mizue | |
| 2012/0015707 | A1 * | 1/2012 | Hornik | G07F 17/3258 463/20 |
| 2012/0052935 | A1 | 3/2012 | Vancura | |
| 2013/0084942 | A1 | 4/2013 | Kelly | |
| 2013/0190070 | A1 | 7/2013 | Bennett | |

* cited by examiner

WAGERING GAME WITH DYNAMIC BONUS TRIGGERS

CROSS-REFERENCE TO RELATED APPLICATIONS

This application is a continuation of U.S. application Ser. No. 13/794,261 (now U.S. Pat. No. 9,183,704), filed Mar. 11, 2013 and titled "Wagering Game With Dynamic Bonus Triggers," which claims the benefit of U.S. Provisional Application No. 61/676,002, filed Jul. 26, 2012, and titled "Wagering Game With Dynamic Bonus Triggers," each of which is hereby incorporated by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a wagering game with dynamic bonus triggers.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system for conducting a wagering game includes one or more input devices, one or more display devices, one or more processors, and one or more memory devices. The memory devices store instructions that, when executed by at least one of the one or more processors, cause the gaming system to receive a wager to initiate each instance of the wagering game using at least one of the one or more input devices, randomly select a game outcome from a plurality of game outcomes for each instance of the wagering game using at least one of the one or more processors, display the randomly selected game outcome for each instance of the wagering game using at least one of the one or more display devices, and initiate a special event in response to an occurrence of a triggering event during an instance of the wagering game. At least two of the randomly selected outcomes include a plurality of symbols displayed on the array that include a first special symbol. The first special symbol has a dynamic secondary element that represents a first enhancement in a first instance of the wagering game and a second enhancement in a second instance of the wagering game. The triggering event is associated with at least one special symbol. The special event is modified by an enhancement represented by the dynamic secondary element of the at least one special symbol during that instance of the wagering game.

According to another aspect of the invention, a method of conducting a wagering game on a wagering game system includes receiving a wager to initiate each instance of a wagering game on the wagering game system using at least one of the one or more input devices, randomly selecting a game outcome from a plurality of game outcomes for each instance of the wagering game using at least one of the one or more processors, displaying the randomly selected game outcome for each instance of the wagering game using at least one of the one or more display devices, and initiating a special event in response to an occurrence of a triggering event during an instance of the wagering game. Each of at least two of the randomly selected outcomes includes a plurality of symbols on the array. The pluralities of symbols includes a first special symbol. The first special symbol has a dynamic secondary element that represents a first enhancement in a first instance and a second enhancement in a second instance of the wagering game. The triggering event is associated with at least one special symbol. The special event is modified by an enhancement that is represented by the dynamic secondary element of the at least one special symbol during that instance of the wagering game.

According to yet another aspect of the invention, a method of conducting a wagering game on a wagering game system includes receiving a wager to initiate each instance of a wagering game on the wagering game system using at least one of one or more input devices, randomly selecting a first game outcome from a plurality of game outcomes for a first instance of the wagering game and a second game outcome from the plurality of game outcomes for a second instance of the wagering game using at least one of one or more processors, displaying the first game outcome including a first plurality of symbols on an array using at least one of one or more display devices, displaying the second game outcome including a second plurality of symbols on the array using at least one of the one or more display devices, and initiating a special event in response to an occurrence of a triggering event associated with at least one special symbol during an instance of the wagering game. The first plurality of symbols includes a first special symbol that has a dynamic secondary element. The dynamic secondary element represents a first enhancement. The second plurality of symbols includes the first special symbol having a dynamic secondary element representing a second enhancement. The special event is modified by the respective enhancement represented by the dynamic secondary element of the at least one special symbol during that instance of the wagering game.

Additional aspects of the invention will be apparent to those of ordinary skill in the art in view of the detailed description of various embodiments, which is made with reference to the drawings, a brief description of which is provided below.

Figure 1:
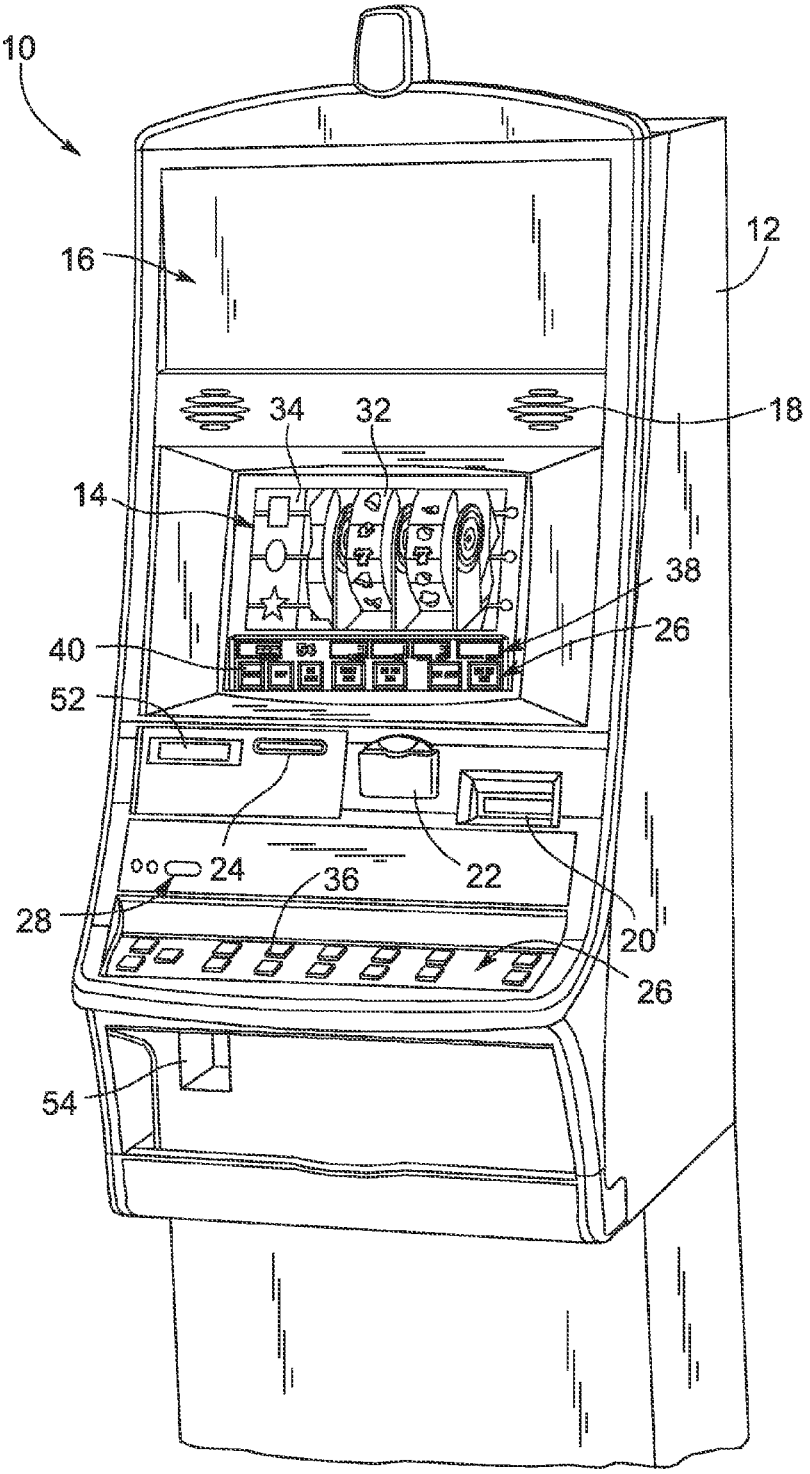
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the words "a," "at least one," and "one or more" can be used interchangeably (unless specifically disclaimed); the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
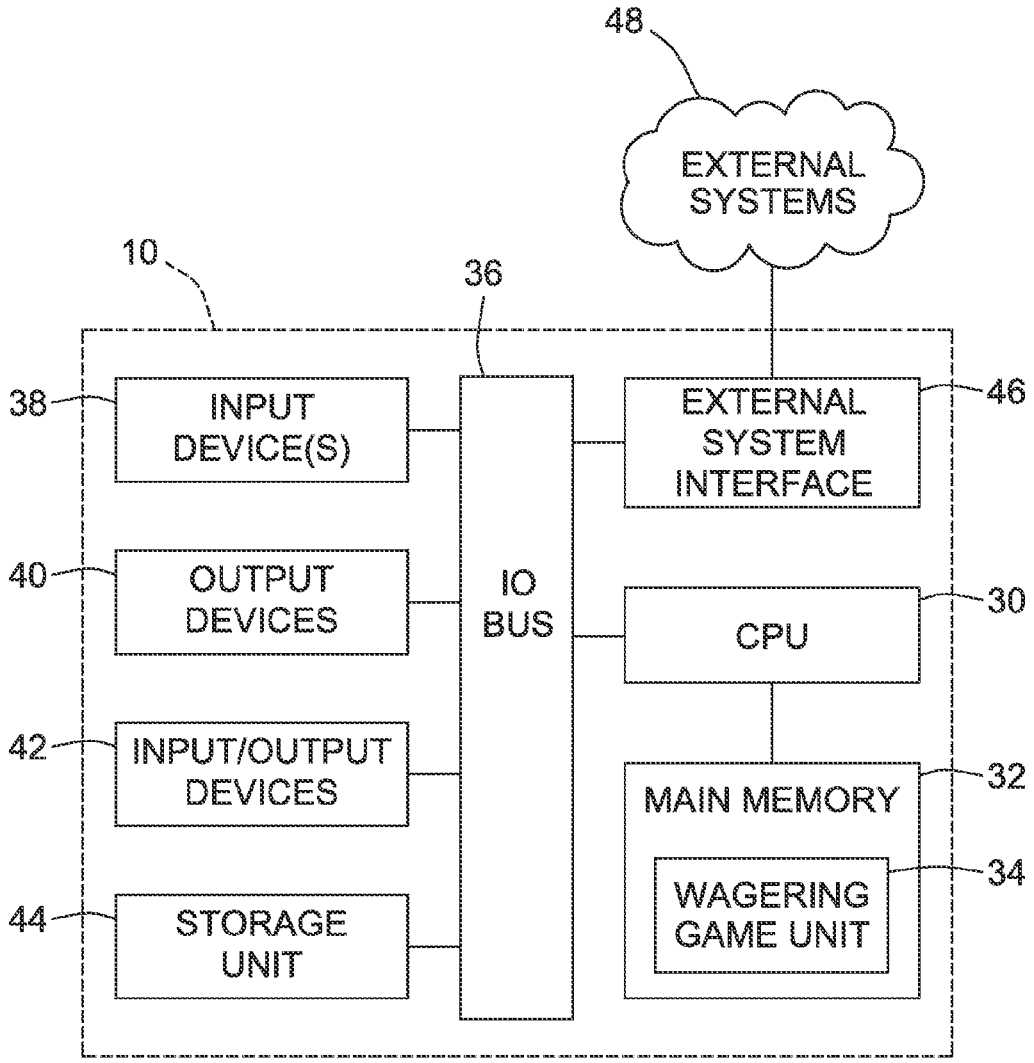
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video blackjack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
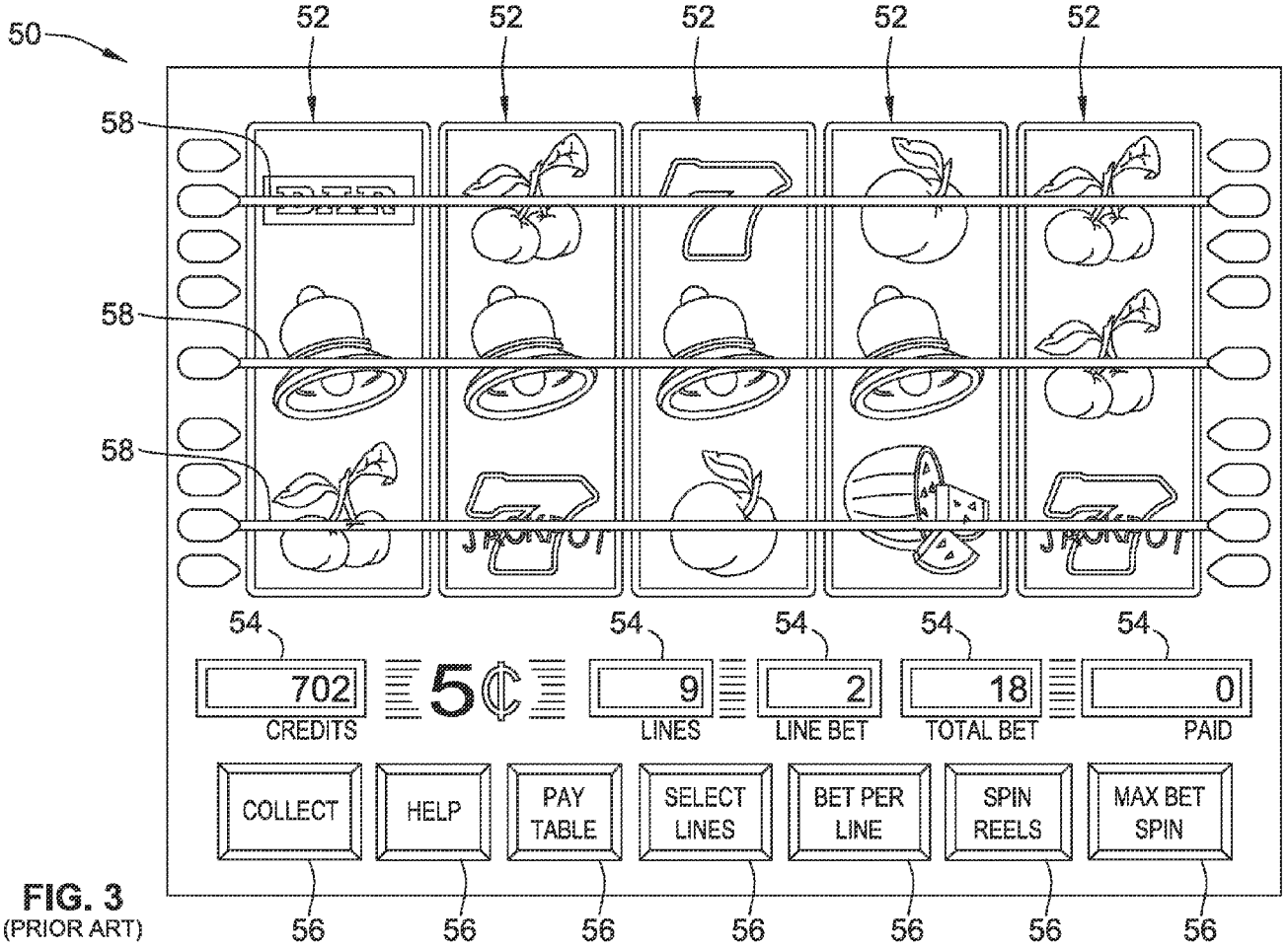
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4A:
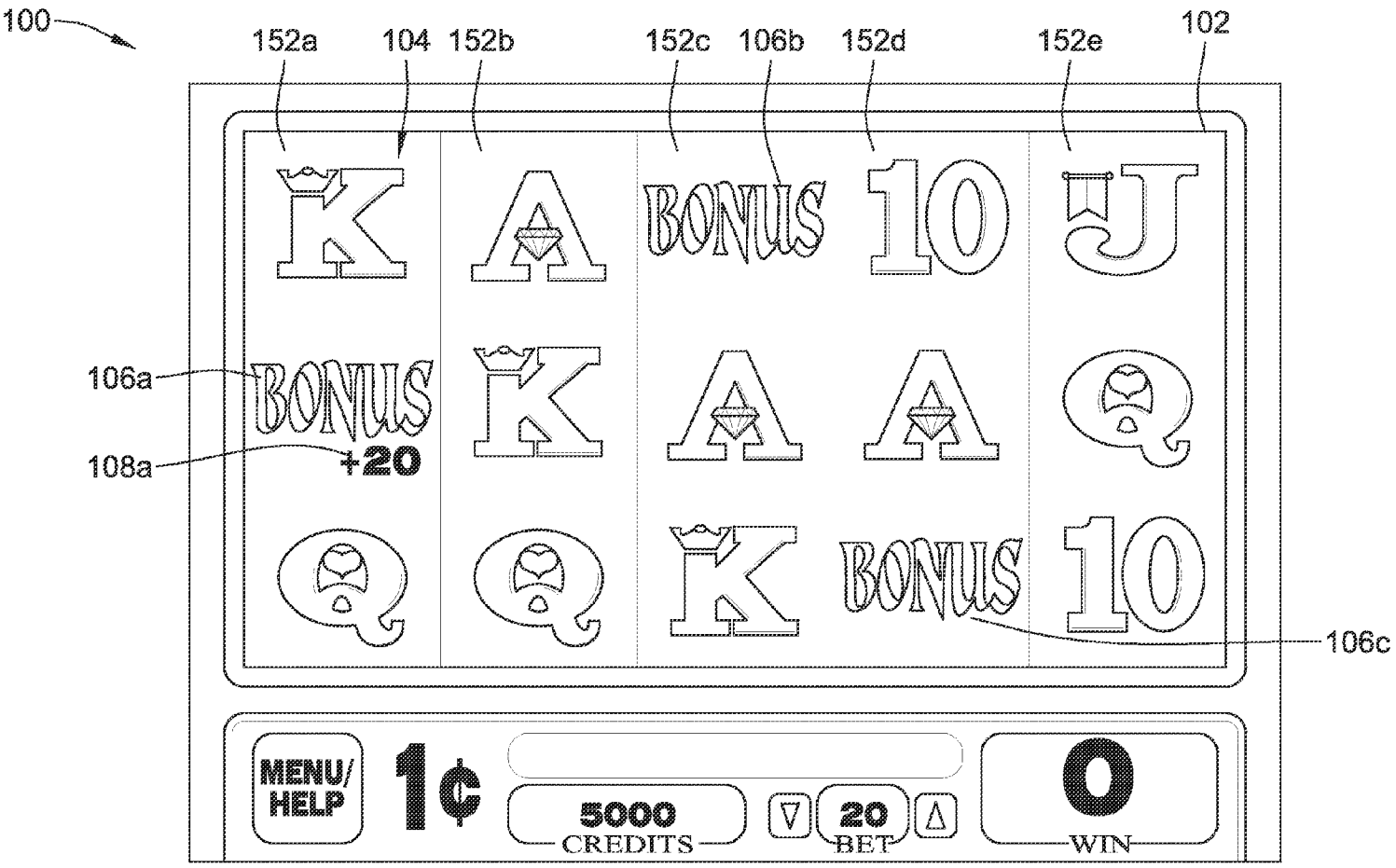
FIG. 4A is an exemplary basic-game screen of a wagering game displayed on a gaming terminal during an instance of the wagering game.
Figure 4B:
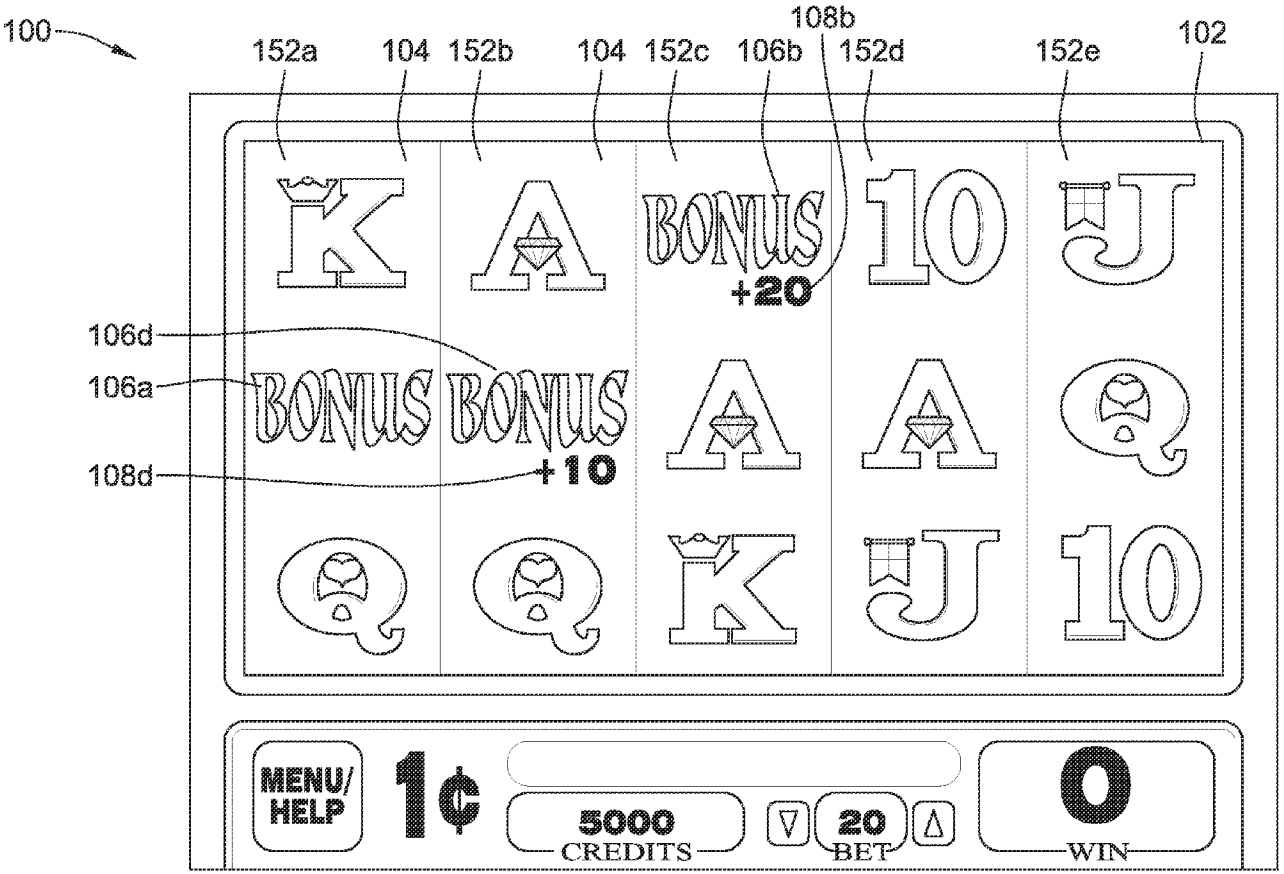
FIG. 4B is another exemplary basic-game screen of a wagering game displayed on a gaming terminal during a second instance of the wagering game.
Figure 4C:
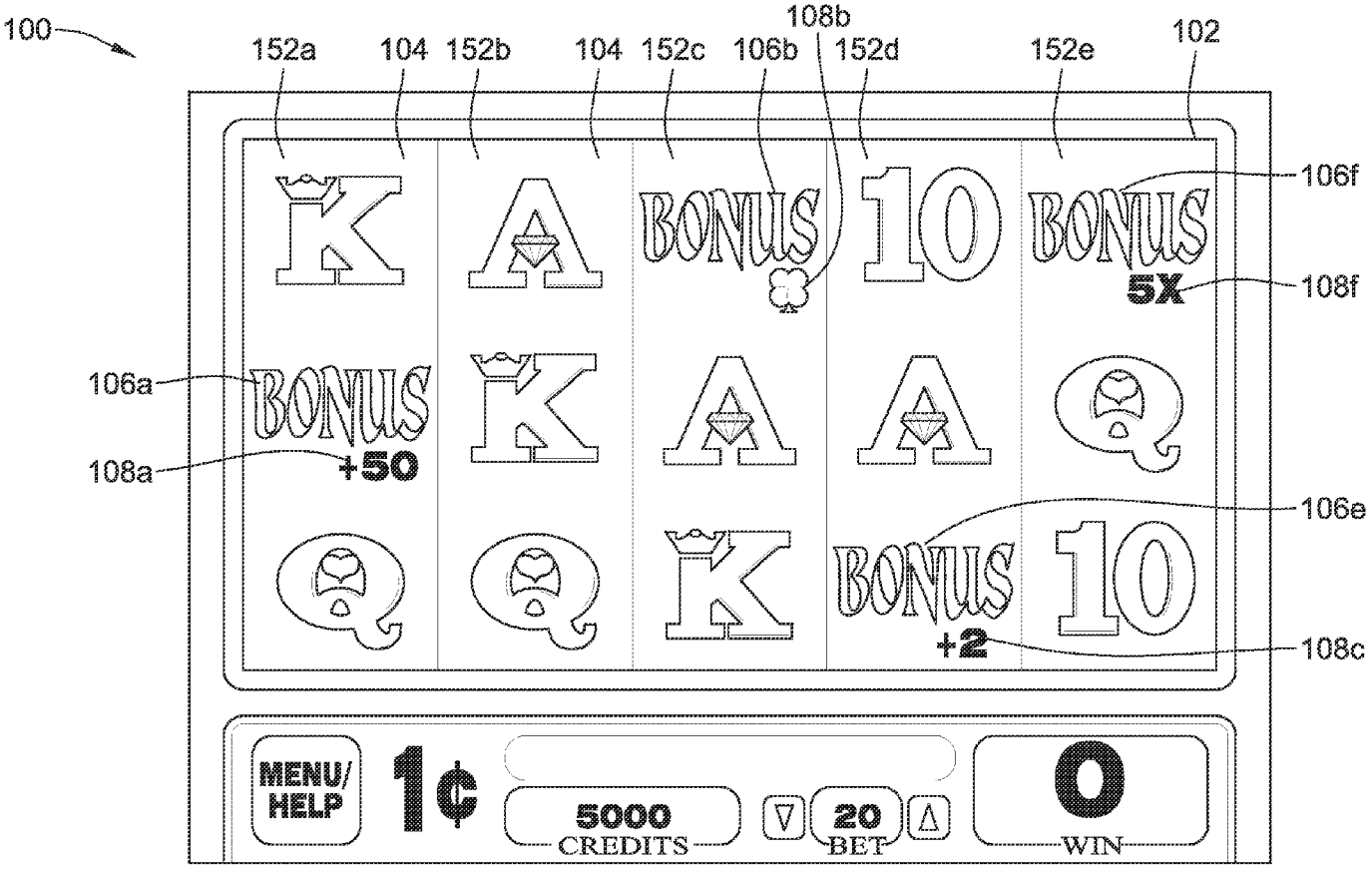
FIG. 4C is yet another exemplary basic-game screen of a wagering game displayed on a gaming terminal during a third instance of the wagering game.

Referring generally to FIGS. 4A-4C, an exemplary basic-game screen 100 of a wagering game is adapted to be displayed on the primary display area 12 or the secondary display area 14. The screen 100 includes an array 102 illustrated in the form of symbol-bearing reels 152*a*-152*e* having a plurality of reel positions 104 thereon. Each of FIGS. 4A-4C illustrates a respective instance (or play) of the wagering game. For example, the instances may be respective spins of a plurality of free spins. In at least two instances of the wagering game, each respective plurality of reel symbols 104 includes one or more special symbols. Each of the one or more special symbols includes a dynamic secondary element. The dynamic secondary element may be assigned a bonus enhancement during an instance that is different from a bonus enhancement assigned during a different instance.

Referring now to FIG. 4A, the exemplary basic-game screen 100 is shown in a first instance of the wagering game (e.g., a first spin of a plurality of spins). The reel positions 104 include three special symbols 106*a*-106*c* displayed in the array 102. Specifically, a first special symbol 106*a* is displayed in a middle position of a first reel 152*a*, a second special symbol 106*b* is displayed in a top position of a third reel 152*c*, and a third special symbol 106*c* is displayed in a bottom position of a fourth reel 152*d*.

In the illustrated instance, only one of the three special symbols 106*a*-106*c* has been randomly assigned to include an associated enhancement feature. Specifically, the first special symbol 106*a* includes a dynamic secondary element 108*a* that awards a player the achievement of a twenty-spin bonus enhancement. Optionally, the dynamic secondary element is displayed as a watermark in the same reel position of reel 152*a* as the first special symbol 106*a* (e.g., the "+20" symbol in the middle position of the first reel 152*a*). The watermark may indicate the type of enhancement (e.g., free spins), the value of the enhancement (e.g., ten free spins), and/or merely that a bonus exists (e.g., a generic symbol associated with one or more bonus enhancements), or may indicate any other type of enhancement or feature. For clarity of description, each of FIGS. 4A-4C displays dynamic secondary elements 108 using a watermark. Each of the remaining special symbols 106*b*, 106*c* displayed on the array 102 lacks an enhancement feature during this instance of the wagering game, as indicated by the absence of a watermark.

Referring now to FIG. 4B, the exemplary basic-game screen 100 is shown in a second instance of the wagering game (e.g., a second spin of the plurality of spins or a first spin in response to another wager). The reel positions 104 include three special symbols 106*a*, 106*b*, 106*d* displayed on the array 102. In this instance, two of the three special symbols 106*a*, 106*b*, 106*d* have been randomly assigned to include associated enhancement features. Specifically, a fourth special symbol 106*d* is located in a middle position of the second reel 152*b* and includes a dynamic secondary element 108*d* that awards the player the achievement of a ten-spin bonus enhancement. In this instance, the dynamic secondary element 108*b* of the second special symbol 106*b* awards the player the achievement of a twenty-spin bonus enhancement and the first special symbol 106*a* lacks an enhancement feature. As illustrated in FIGS. 4A and 4B, the same special symbols 106*a* and 106*b* are displayed in the array 102. However, as can be seen, the dynamic secondary elements 108*a* and 108*b* vary from wagering-game instance to wagering-game instance. It should be noted that while symbols 106*a* and 106*b* appear in the same position in the array 102 in FIGS. 4B and 4C, both the special symbols 106*a* and 106*b* and their associated dynamic secondary elements 108*a* and 108*b* are static symbol locations on the respective reels 152*a*-*e* and, in the illustrated embodiment, are not affected by or associated with a particular position on the array 102 (though they may appear in the same array position over the course of two or more wagering-game instances).

Referring now to FIG. 4C, the exemplary basic-game screen 100 is shown in a third instance the wagering game (e.g., a third spin of the plurality of spins or a first spin in response to another wager). The reel positions 104 include four special symbols 106*a*, 106*b*, 106*e*, 106*f* displayed on the array 102. In this instance, each one of the special symbols 106*a*, 106*b*, 106*e*, 106*f* has been randomly assigned to include an associated enhancement feature. Specifically, a fifth special symbol 106*e* is located in a bottom position of the fourth reel 152*d* and includes a dynamic secondary element 108*e* that awards the player the achievement of a two-spin bonus enhancement and a sixth special symbol 106*f* is located in a top position of the fifth reel 152*e* and includes a dynamic secondary element 108*f* that awards the player the achievement of a five-times-multiplier bonus enhancement. In this instance, the dynamic secondary element 108*a* of the first special symbol 106*a* awards the player a fifty-spin bonus enhancement and the dynamic secondary element 108*b* of the second special symbol 106*b* awards the player a random bonus enhancement. It is contemplated that a generic symbol (e.g. a four-leaf clover) may, alternatively, be associated with a single bonus enhancement.

The dynamic secondary elements are randomly assigned from instance to instance of the wagering game. As such, the secondary elements are variable in nature (i.e., change from instance to instance). For example, in each instance of the wagering game, the same position of the array 102 is randomly assigned to (a) lack a special symbol, (b) include a first special symbol without a bonus enhancement, (c) include the first special symbol with a first bonus enhancement, (d) include the first special symbol with a second bonus enhancement, (e) include a second special symbol with the first bonus enhancement, etc. Thus, in a first instance the top left position of the array 102 may lack a special symbol altogether, in a second instance the same position may include a special symbol with a first bonus enhancement assigned to the dynamic secondary element, and in a third instance the same position may include the same special symbol without any bonus enhancement assigned to the dynamic secondary element.

Furthermore, the secondary element of the special symbol can vary from wagering-game instance to wagering-game instance such that a different bonus enhancement feature is assigned to the same reel position. For example, in a first instance a first special symbol at a first position of the reel strip forming the first reel 152*a* may include a secondary element that awards a ten-spin bonus enhancement, and in a second instance the first special symbol at the first position of the reel strip may include a secondary element that awards a twenty-spin bonus enhancement. Similarly, in a third instance the first special symbol may include a secondary element that does not award any bonus enhancement.

Figure 5:
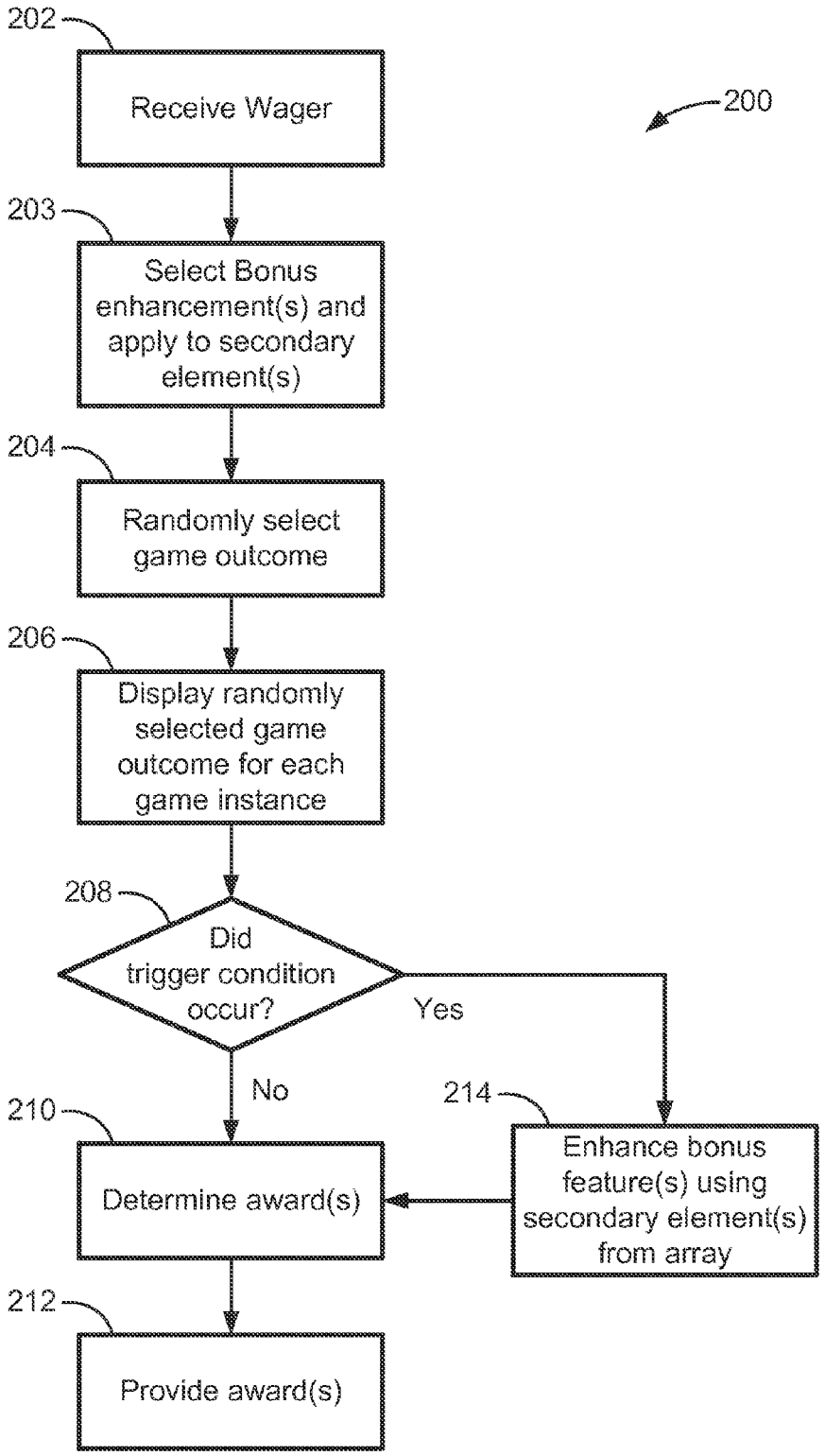
FIG. 5 is a flowchart for an algorithm that corresponds to instructions executed by a controller in accord with at least some aspects of the disclosed concepts.

FIG. 5 illustrates a schematic depiction of one algorithm that corresponds to at least some instructions that can be executed by the CPU 30 and/or external systems 48 to perform the above described functions associated with the disclosed concepts. By way of non-limiting example, the exemplary algorithm 200 includes receiving a wager, at step 202, from a player to initiate each instance of a wagering game. The wager is placed or otherwise confirmed, for example, using a bill validator 22, coin acceptor, information reader 24, or other input device. It is contemplated that a single wager may initiate a first instance of the wagering game, and that some event or occurrence during the first instance may provide a second instance of the wagering game without input of a second wager.

At step 203, an enhancement or enhancements are selected from a group of enhancements and assigned to one or more dynamic secondary elements for a first instance of the wagering game. Each subsequent instance of the wagering game includes an enhancement or enhancements selected from a group of enhancements and assigned to one or more dynamic secondary elements. Enhancements may include bonus enhancements such as a "free spins" bonus enhancement, a "win multiplying" bonus enhancement, a "mystery" bonus enhancement, a "random wild" bonus enhancement, a "roaming wild" bonus enhancement, an "expanding wild" bonus enhancement, a "symbol clump" bonus enhancement, etc. Optionally, the dynamic secondary element may not provide a bonus enhancement. This may be accomplished by not assigning a bonus enhancement to the dynamic secondary element or by assigning a null enhancement to the dynamic secondary element. It is contemplated that the secondary elements of each instance may be re-initialized for each instance or may include bonus enhancements that were assigned during previous instances.

By way of non-limiting example, a reel may include a "K" symbol, a "BONUS" special symbol having a dynamic secondary element, and a "Q" symbol occupying adjacent position on the reel (shown, for example, by the portion of the reel strip illustrated by the first reel 152*a* in FIGS. 4A-4C). In each instance of the wagering game, the "K" symbol, the "BONUS" symbol, and the "Q" symbol are located at the same position along the reel strip. However, the "BONUS" symbol can have an enhancement assigned to the dynamic secondary element of the special symbol that is different in each instance. In a first instance, the dynamic secondary element may be assigned a twenty-spin bonus enhancement (e.g., the dynamic secondary element 108*a* of the first special symbol 106*a* in FIG. 4A). In a second instance, the dynamic secondary element may be assigned a null enhancement or may not be assigned an enhancement (e.g., the fourth special symbol 106*d* of FIG. 4B). In a third instance, the dynamic secondary element may be assigned a fifty-spin bonus enhancement (e.g., the dynamic secondary element 108*a* of the first special symbol 106*a* in FIG. 4C).

For each instance of the wagering game, the gaming system randomly selects a game outcome at step 204. This can be accomplished, for example, by selecting a game outcome from a plurality of game outcomes. Another example includes having an array formed by a plurality of symbol-bearing reels placed in a side-by-side arrangement. A plurality of symbols is disposed on each reel. The plurality of symbols on at least one of the reels includes a special symbol having a dynamic secondary element. Each symbol from the plurality of symbols occupies a distinct symbol position along the reel strip. The array would display at least one symbol position from each reel. The displayed symbol positions would be adjacent symbol positions from each reel. The randomly selected outcome would then be generated by spinning the plurality of reels.

At step 206, the randomly selected game outcome is displayed. If a triggering condition is determined to have occurred, at step 208, a bonus feature in enabled. If no triggering condition has occurred, a determination is made at step 210 whether any awards should be awarded. After the awards are determined, the player is provided with the awards at step 212 and play of the wagering game continues.

By way of non-limiting example, the triggering condition of one illustrative embodiment is three or more special symbols being displayed on an array. Three scattered special symbols displayed on the array awards a bonus feature of ten free spins, four scattered special symbols awards twenty free spins, five scattered special symbols awards fifty free spins, etc. (e.g., in FIG. 4B the player would be provided ten free spins for the three displayed special symbols). This award is then enhanced at step 214 by any dynamic secondary elements associated with the respective special symbols that triggered the bonus feature (e.g., in FIG. 4B the player would be provided an additional thirty free spins by adding the twenty-spin bonus enhancement 108*a* and the ten-spin bonus enhancement 108*b* together). At step 210, a determination is made whether to award any awards. This includes awards from the base game outcome, the outcome of any applied bonus features, and the outcome of any applied enhancements. After the awards are determined, the player is provided with the awards at step 212 and play of the wagering game continues The special symbols 106 may additionally or alternatively award bonus features such as a "wild reel" bonus, an "expanding wild reel" bonus, a "random wilds" bonus, a "clumped symbols" bonus, etc. The triggering condition can include a predetermined number of special symbols 106 occurring in a payline, a predetermined number of bonus symbols 106 appearing on the array, and/or one or more special symbols 106 occurring at predetermined locations on the array. It is contemplated that other awards or triggering conditions may be used. Additionally, the occurrence of special symbols 106 in excess of those required for a triggering condition to occur may add additional awards. For example, three special symbols 106 displayed on the array may award a five-times winning multiplier, whereas four special symbols 106 displayed may award a ten-times winning multiplier.

Additional features or enhancements may be used to attract frequent play through enhanced entertainment value to the player. One feature can be to allow a user to select a charm to be displayed on the screen during play of the wagering game. The user-selectable charm can allow the user to believe that they have an influence on the outcome of the wagering game. One non-limiting example of this would be to provide the user with an opportunity to pick the user-selectable charm prior to playing. Additionally or alternatively, the user may be allowed to select a different user-selectable charm during continued play at the wagering game machine to encourage believe that the user may change their luck. Some examples of a user-selectable charm include a troll, a teddy bear, a four-leaf clover, a rabbit's foot, etc.

The user-selectable charm may be animated in response to a user interaction with the machine or the user-selectable charm itself. For example, the user may rub the screen to animate the troll or cause the four leaf clover to grow. The charm may even interact with the array before, during, or after play to simulate having an effect on the game outcome. For example, the troll may initiate the spinning of the reels, may cause the reels to spin backward, or may "blindfold" the user by darkening the reels so that the user must the only initial feedback to the user is the sound a win on the machine makes. These animations and interactions can be used without affecting the game outcomes. Alternatively, the animations or user-selectable charms could correspond with an increased probability of an event occurring while not affecting the expected value of the game. In this scenario, a statistics page can be incorporated to display the likelihood of each user-selectable charm triggering a certain event so that future users can choose a user-selectable charm based on that information. It is contemplated that a user or a casino may also be allowed to design their own charms which are stored for access by the gaming system.

Each of these embodiments and obvious variations thereof is contemplated as falling within the spirit and scope of the claimed invention, which is set forth in the following claims.

What is claimed is:

1. A gaming system comprising:

an electronic display device;

an electronic input device; and one or more controllers configured to:

detect, via the electronic input device, a physical item associated with a monetary value that establishes a credit balance displayed on a credit meter;

initiate a wagering game in response to an input indicative of a wager covered by the credit balance;

randomly select a game outcome from a plurality of game outcomes;

select one or more bonus enhancements to be assigned to one or more dynamic secondary elements;

direct the electronic display device to display symbols on a plurality of symbol-bearing reels representing the game outcome, the symbols spinning and stopping with the symbol-bearing reels, the symbols selected from a plurality of symbols that includes a special symbol that triggers a bonus feature, the special symbol including a dynamic secondary element of the one or more dynamic secondary elements that indicates a value of an enhancement;

in response to a triggering event with the special symbol occurring in the displayed symbols, the special symbol having spun and stopped in static relation to other symbols on at least one of the symbol-bearing reels, execute the bonus feature as modified by the bonus enhancement assigned to the dynamic secondary element displayed when the symbols stop spinning; and award any awards resulting from the selected game outcome and the modified bonus feature.

2. The gaming system of claim 1, wherein the dynamic secondary element is displayed as a visible mark proximal the special symbol.

3. The gaming system of claim 1, wherein the plurality of symbols includes more than one special symbol and the one or more controllers are further configured to randomly select which special symbol includes the dynamic secondary element.

4. The gaming system of claim 1, wherein the triggering event includes displaying a plurality of special symbols.

5. The gaming system of claim 1, wherein the one or more controllers are further configured to randomly select the one or more bonus enhancements to be assigned to the one or more dynamic secondary elements.

6. The gaming system of claim 1, wherein the one or more controllers are further configured to assign a first bonus enhancement to one of the one or more dynamic secondary elements and a second, different bonus enhancement to another of the one or more dynamic secondary elements.

7. The gaming system of claim 1, wherein one special symbol included in the plurality of symbols includes one of the one or more dynamic secondary elements and another special symbol included in the plurality of symbols includes another, different dynamic secondary element of the one or more dynamic secondary elements.

8. The gaming system of claim 1, wherein the one or more controllers are further configured to select the one or more bonus enhancements to be assigned to the one or more dynamic secondary elements after initiating the wagering game.

9. A method of conducting a wagering game on a wagering game system, the method comprising:

detecting, via an electronic input device, a physical item associated with a monetary value that establishes a credit balance displayed on a credit meter;

initiating, via at least one of one or more controllers, the wagering game in response to an input indicative of a wager covered by the credit balance;

randomly selecting, via at least one of the one or more controllers, a game outcome for the wagering game from a plurality of game outcomes;

selecting one or more bonus enhancements to be assigned to one or more dynamic secondary elements;

displaying, on an electronic display device directed by at least one of the one or more controllers, symbols on a plurality of symbol-bearing reels representing the game outcome, the symbols spinning and stopping with the symbol-bearing reels, the symbols selected from a plurality of symbols that includes a special symbol that triggers a bonus feature, the special symbol including a dynamic secondary element of the one or more secondary elements that indicates a value of an assigned bonus enhancement;

in response to a triggering event with the special symbol occurring in the displayed symbols, the special symbol having spun and stopped in static relation to other symbols on at least one of the symbol-bearing reels, executing, via at least one of the one or more controllers, the bonus feature as modified by the value of the bonus enhancement assigned to the dynamic secondary element displayed when the symbols stop spinning; and awarding any awards resulting from the game outcome and the modified bonus feature.

10. The method of claim 9, wherein the dynamic secondary element is displayed as a visible mark appearing in the same reel position as the first special symbol.

11. The method of claim 9, wherein the triggering event includes displaying a plurality of special symbols.

12. The method of claim 9, wherein the one or more bonus enhancements are randomly selected, via at least one of the one or more controllers, to be assigned to the one or more dynamic secondary elements.

13. The method of claim 9, wherein selecting one or more bonus enhancements to be assigned to one or more dynamic secondary elements includes assigning a first bonus enhancement to one of the one or more dynamic secondary elements and a second, different bonus enhancement to another of the one or more dynamic secondary elements.

14. The method of claim 9, wherein one special symbol included in the plurality of symbols includes one dynamic secondary element and another special symbol included the plurality of symbols includes another, different dynamic secondary element.

15. The method of claim 9, wherein the one or more bonus enhancements to be assigned to the one or more dynamic secondary elements are selected after initiating the wagering game.

16. A gaming system comprising:

a gaming machine configured to play at least one casino wagering game, the gaming machine including an electronic input device and an electronic display device; and one or more controllers configured to:

detect, via the electronic input device, a physical item associated with a monetary value that establishes a credit balance for wagering on the gaming machine;

initiate the casino wagering game on the gaming machine in response to an input indicative of a wager covered by the credit balance;

randomly assign a first dynamic secondary element including a first bonus enhancement to a first special symbol of a plurality of game symbols, and a second dynamic secondary element including a second bonus enhancement to a second special symbol of the plurality of game symbols, the first dynamic secondary element indicating a value of the first bonus enhancement, the second bonus enhancement being a different type of bonus enhancement than the first bonus enhancement;

determine an outcome of the casino wagering game;

direct the electronic display device to display game symbols on a plurality of symbol-bearing reek representing the outcome of the casino wagering game; the game symbols spinning and stopping with the symbol-bearing reels, the displayed game symbols selected from the plurality of game symbols;

in response to a triggering event with the first special symbol and the second special symbol occurring in the displayed game symbols, the first and second special symbols having spun and stopped in static relation to other symbols on at least one of the symbol-bearing reels, execute a bonus feature as modified by the first bonus enhancement assigned to the first dynamic secondary element displayed when the symbols stop spinning and by the second bonus enhancement assigned to the second dynamic secondary element;

award any awards resulting from the outcome and the modified bonus feature; and receive a cashout input that initiates a payout from the credit balance.

17. The gaming system of claim 16, wherein at least one of the one or more controllers resides on a server on an external network in communication with the gaming machine and the at least one controller selects the first bonus enhancement assigned to the first dynamic secondary element from a plurality of bonus enhancements.

18. The gaming system of claim 16, wherein the first special symbol and the second special symbol are the same symbol.

19. The gaming system of claim 16, wherein the value of the first bonus enhancement is a predetermined number of free spins during the bonus feature.

20. The gaming system of claim 16, wherein the type of the second bonus enhancement is one of free spins, win multiplying, mystery, random wild, roaming wild, expanding wild, or symbol clump bonus enhancements.

* * * * *